US011694826B2

(12) United States Patent
Asada et al.

(10) Patent No.: US 11,694,826 B2
(45) Date of Patent: Jul. 4, 2023

(54) METHOD OF PREPARING BONDED MAGNET AND BONDED MAGNET

(71) Applicant: NICHIA CORPORATION, Anan (JP)

(72) Inventors: Takashi Asada, Ibaraki (JP); Shuichi Tada, Anan (JP)

(73) Assignee: NICHIA CORPORATION, Anan (JP)

( * ) Notice: Subject to any disclaimer, the term of this patent is extended or adjusted under 35 U.S.C. 154(b) by 202 days.

(21) Appl. No.: 16/728,320

(22) Filed: Dec. 27, 2019

(65) Prior Publication Data

US 2020/0211742 A1 Jul. 2, 2020

(30) Foreign Application Priority Data

Dec. 18, 2019 (JP) ..... 2019-228312

(51) Int. Cl.
*H01F 1/059* (2006.01)
*H01F 1/055* (2006.01)
*H01F 1/20* (2006.01)

(52) U.S. Cl.
CPC ..... *H01F 1/059* (2013.01); *H01F 1/0558* (2013.01); *H01F 1/20* (2013.01)

(58) Field of Classification Search
None
See application file for complete search history.

(56) References Cited

U.S. PATENT DOCUMENTS 4,141,943 A * 2/1979 Houska ..... H01F 1/0558 148/301
5,167,715 A * 12/1992 Kalafala ..... H01F 6/06 118/429
6,103,157 A * 8/2000 Behm ..... C08K 3/01 264/102
2008/0199118 A1* 8/2008 Yabe ..... G01P 3/443 384/448
2008/0211142 A1* 9/2008 Hollstein ..... C08G 59/687 523/400

(Continued)

FOREIGN PATENT DOCUMENTS

EP 0417733 A2 3/1991
FR 2366678 A1 4/1978

(Continued)

OTHER PUBLICATIONS

Machine Translation of JP-2014146655-A (Year: 2014).*

*Primary Examiner* — Kevin E Yoon
*Assistant Examiner* — Ryan L Heckman
(74) *Attorney, Agent, or Firm* — Hunton Andrews Kurth LLP

(57) ABSTRACT

The present disclosure aims to provide a bonded magnet having good magnetic properties and a method of preparing the bonded magnet. The present disclosure provides a method of preparing a bonded magnet, including: a first compression step of compressing a magnetic powder having an average particle size of 10 μm or less while magnetically orienting it to obtain a first molded article; a second compression step of bringing the first molded article into contact with a thermosetting resin having a viscosity of 200 mPa·s or less, followed by compression to obtain a second molded article; and a heat treatment step of heat treating the second molded article.

11 Claims, 1 Drawing Sheet

(56) References Cited

U.S. PATENT DOCUMENTS

| | | | | |
|---|---|---|---|---|
| 2010/0261038 | A1* | 10/2010 | Imaoka | B22F 1/02 428/800 |
| 2013/0266474 | A1* | 10/2013 | Maeda | B22F 3/24 419/66 |
| 2017/0186531 | A1* | 6/2017 | Ohtsubo | H01F 41/10 |
| 2017/0278618 | A1 | 9/2017 | Matsui et al. | |

FOREIGN PATENT DOCUMENTS

| | | | | |
|---|---|---|---|---|
| JP | S53-48020 | A | | 5/1978 |
| JP | S5515225 | A | | 2/1980 |
| JP | S56023710 | A | | 3/1981 |
| JP | H03114206 | A | | 5/1991 |
| JP | 2007142032 | A | | 6/2007 |
| JP | 2011-216641 | A | | 10/2011 |
| JP | 2014146655 | A | * | 8/2014 |
| JP | 2014146655 | A | | 8/2014 |
| JP | 2015153778 | A | | 8/2015 |
| WO | 2016117201 | A1 | | 7/2016 |

* cited by examiner

METHOD OF PREPARING BONDED MAGNET AND BONDED MAGNET

CROSS-REFERENCE TO RELATED PATENT APPLICATION

This application claims priority to Japanese Patent Application No. 2018-246686 filed on Dec. 28, 2018 and Japanese Patent Application No. 2019-228312 filed on Dec. 18, 2019. The disclosures of Japanese Patent Application No. 2018-246686 and Japanese Patent Application No. 2019-228312 are hereby incorporated by reference in their entireties.

BACKGROUND

Technical Field

The present disclosure relates to a method of preparing a bonded magnet and a bonded magnet.

Description of Related Art

JP 2014-146655 A discloses a bonded magnet including a rare earth magnetic powder and a binder containing a thermoplastic resin and a thermosetting resin. According to its teachings, a bonded magnet having a high magnetic powder filling factor without a decrease in strength may be produced by bonding a magnetic powder with a small amount of thermoplastic resin enough to retain the shape, to obtain a molded article, and then impregnating the voids in the molded article with a liquid thermosetting resin to reduce the resin component content compared to conventional bonded magnets.

However, the magnetic powder to be used in this method has an average particle size of 10 μm or more, and a magnetic powder with a particle size as large as 150 μm is only used in the examples. With such a large particle size, the decrease in magnetic powder filling factor will not cause a major issue. When this method is applied to magnetic powders having a very small average particle size of 10 μm or less, no significant improvement in filling factor is expected.

SUMMARY

The present disclosure aims to provide a bonded magnet having good magnetic properties and a method of preparing the bonded magnet.

Embodiments of the present disclosure relate to a method of preparing a bonded magnet, including: a first compression step of compressing a magnetic powder having an average particle size of 10 μm or less while magnetically orienting it to obtain a first molded article; a second compression step of bringing the first molded article into contact with a thermosetting resin having a viscosity of 200 mPa·s or less, followed by compression to obtain a second molded article; and a heat treatment step of heat treating the second molded article.

Embodiments of the present disclosure relate to a bonded magnet, containing: a magnetic powder having an average particle size of 10 μm or less; and a cured product of a thermosetting resin having a viscosity of 200 mPa·s or less, wherein the bonded magnet has a percentage of lack of impregnation of 1% or less.

With the method of preparing a bonded magnet of the present disclosure, it is possible to produce a bonded magnet having improved magnetic properties by increasing the magnetic powder filling factor and magnetic orientation ratio.

DETAILED DESCRIPTION

Figure 1:
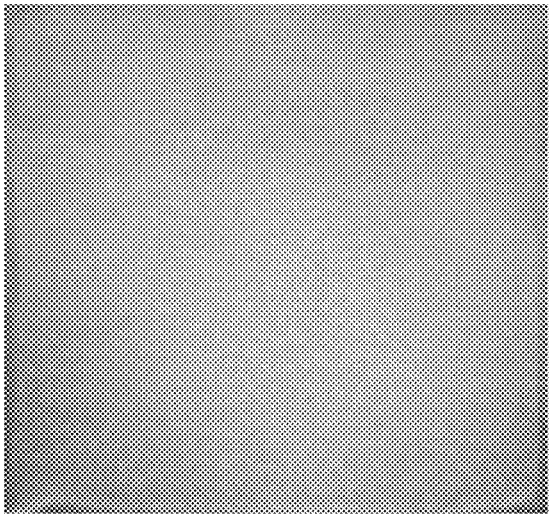
FIG. 1 shows a cross section of a bonded magnet of Example 1.

Embodiments of the present disclosure are described in detail below. The following embodiments, however, are intended as examples to embody the technical idea of the present disclosure and are not intended to limit the scope of the present disclosure to the following embodiments. As used herein, the term "step" encompasses not only an independent step but also a step that may not be clearly distinguished from other steps, as long as a desired object of the step is achieved.

The method of preparing a bonded magnet according to the present embodiment includes: a first compression step of compressing a magnetic powder having an average particle size of 10 μm or less while magnetically orienting it to obtain a first molded article; a second compression step of bringing the first molded article into contact with a thermosetting resin having a viscosity of 200 mPa·s or less, followed by compression to obtain a second molded article; and a heat treatment step of heat treating the second molded article. It is believed that when a first molded article obtained by compressing a magnetic powder while magnetically orienting it is brought into contact with a thermosetting resin having a viscosity of 200 mPa·s or less, followed by compression and heat treatment to cure the thermosetting resin, the resulting bonded magnet has increased magnetic powder filling factor and magnetic orientation ratio and thus improved magnetic properties.

First Compression Step

The first compression step includes compressing a magnetic powder having an average particle size of 10 μm or less while magnetically orienting it to obtain a first molded article. The first compression step may be performed only once or multiple times.

The magnetic powder may be made of any material, such as a SmFeN, NdFeB, or SmCo rare earth magnetic material. Among these, it is preferably a SmFeN magnetic powder because of its heat resistance and absence of rare metals. The SmFeN magnetic powder may be a nitride having a $Th_2Zn_{17}$-type crystal structure and containing the rare earth metal Sm, iron (Fe), and nitrogen (N) as represented by the general formula: $Sm_xFe_{100-x-y}N_y$, preferably wherein the value "x" is at least 8.1 at % but not more than 10 at %; the value "y" is at least 13.5 at % but not more than 13.9 at %; and the balance is mainly Fe.

The SmFeN magnetic powder may be produced as described in JP H11-189811 A. The NdFeB magnetic powder may be produced by an HDDR process as described in WO 2003/85147. The SmCo magnetic powder may be produced as described in JP H08-260083 A.

The average particle size of the magnetic powder may be 10 μm or less. In view of magnetic properties, it is preferably 6 μm or less, more preferably 4 μm or less. With an average particle size of more than 10 μm, the magnetic powder tends to have a significantly reduced coercive force due to the increased grain size. Herein, the average particle size is defined as the particle size corresponding to the 50th percentile by volume from the smallest particle size in a particle size distribution.

The magnetic powder may be subjected to phosphate treatment. The phosphate treatment results in formation of a passive film having a P-0 bond on the surface of the magnetic powder.

The phosphate treatment may be carried out by reacting the magnetic powder with a phosphate treatment agent. Examples of the phosphate treatment agent include orthophosphoric acid, sodium dihydrogen phosphate, potassium dihydrogen phosphate, ammonium dihydrogen phosphate, diammonium hydrogen phosphate, zinc phosphate, calcium phosphate, and other phosphates, hypophosphorous acid and hypophosphites, pyrophosphoric acid, polyphosphoric acid, and other inorganic phosphoric acids, and organic phosphoric acids, and salts thereof.

From the standpoint of protection against oxidation during the preparation of a molded article and during use of the molded article, the magnetic powder is preferably subjected to a silica treatment in which it is treated with an alkyl silicate. The alkyl silicate may be a compound represented by the following general formula:

$$Si_nO_{(n-1)}(OR)_{(2n+2)}$$

wherein R represents an alkyl group, and n represents an integer of 1 to 10. The alkyl silicate is preferably methyl silicate or ethyl silicate.

In the silica treatment, the alkyl silicate and an aqueous medium required to hydrolyze the silicate may be mixed with the magnetic powder, followed by heat treatment in an inert gas atmosphere to form a silica coating. Examples of the aqueous medium required to hydrolyze the silicate include acidic aqueous solutions such as acetic acid, sulfuric acid, and phosphoric acid aqueous solutions, and basic aqueous solutions such as ammonia water, sodium hydroxide and potassium hydroxide aqueous solutions. The amount of the alkyl silicate mixed is preferably at least 1 but not more than 4 parts by weight, more preferably at least 1.5 but not more than 2.5 parts by weight, per 100 parts by weight of the magnetic powder.

The magnetic powder is preferably treated with a coupling agent in order to enhance the magnetic properties of the magnetic powder and to improve wettability between the magnetic powder and the resin and magnet strength. In particular, the magnetic powder having been subjected to the silica treatment is preferably treated with a coupling agent.

Examples of the coupling agent include, but are not limited to, silane coupling agents containing no alkyl or alkenyl group having at least 8 but not more than 24 carbons, and coupling agents containing an alkyl or alkenyl group having at least 8 but not more than 24 carbons. The carbon number of the alkyl or alkenyl group is preferably at least 10 but not more than 24. With a carbon number of less than 8, the coupling agent may provide insufficient lubricity, while with a carbon number of more than 24, the treatment liquid may be significantly viscous, making it difficult to form a uniform coating.

Examples of the coupling agents containing an alkyl or alkenyl group having at least 8 but not more than 24 carbons include silane coupling agents, phosphate coupling agents, and hydrogen phosphite coupling agents. These coupling agents may be used alone or in combinations of two or more. The term "coupling agent" refers to a compound having two or more different groups in the molecule, in which one of the groups is a group that acts on an inorganic material and the other is a group that acts on an organic material.

Examples of the silane coupling agents containing an alkyl or alkenyl group having at least 8 but not more than 24 carbons include compounds represented by the following general formula:

$$(R^1)_xSi(OR^2)_{(4-x)}$$

wherein $R^1$ represents an alkyl group represented by $C_nH_{2n+1}$ or an alkenyl group represented by $C_nH_{2n-1}$, where n represents an integer of 8 to 24; $R^2$ represents an alkyl group represented by $C_mH_{2m+1}$, where m represents an integer of 1 to 4; and x represents an integer of 1 to 3. Specific examples include decyltrimethoxysilane, decyltriethoxysilane, dodecyltrimethoxysilane, dodecyltriethoxysilane, hexadecyltrimethoxysilane, hexadecyltriethoxysilane, octadecyltrimethoxysilane, octadecyltriethoxysilane, and octyltriethoxysilane. Among these, octadecyltriethoxysilane or octyltriethoxysilane is preferred. In the silane coupling agents, the group that acts on an organic material is, for example, one in which a silicon atom is directly bonded to a carbon atom, and corresponds to $R^1$ in the formula, in which the group that acts on an inorganic material is $OR^2$.

Examples of the phosphate coupling agents containing an alkyl or alkenyl group having at least 8 but not more than 24 carbons include compounds represented by the following general formula:

$$(R^1O)_xPO(OH)_{(3-x)}$$

wherein $R^1$ represents an alkyl group represented by $C_nH_{2n+1}$ or an alkenyl group represented by $C_nH_{2n-1}$, where n represents an integer of 8 to 24, and x represents an integer of 1 to 2. Specific examples include didecyl acid phosphate, isodecyl acid phosphate, isotridecyl acid phosphate, lauryl acid phosphate, oleyl acid phosphate, stearyl acid phosphate, isostearyl acid phosphate, and tetracosyl acid phosphate. Among these, oleyl acid phosphate is preferred. In the phosphate coupling agents, the group that acts on an organic material corresponds to $R^1O$ in the formula, in which the group that acts on an inorganic material is OH.

Examples of the hydrogen phosphite coupling agents containing an alkyl or alkenyl group having at least 8 but not more than 24 carbons include compounds represented by the following general formula:

$$(R^1O)_2POH$$

wherein $R^1$ represents an alkyl group represented by $C_nH_{2n+1}$ or an alkenyl group represented by $C_nH_{2n-1}$, where n represents an integer of 8 to 24. Specific examples include didecyl hydrogen phosphite, dilauryl hydrogen phosphite, and dioleyl hydrogen phosphite. Among these, dioleyl hydrogen phosphite is preferred. In the hydrogen phosphite coupling agents, the group that acts on an organic material corresponds to $R^1O$ in the formula, in which the group that acts on an inorganic material is OH.

The silane coupling agents, phosphate coupling agents, or hydrogen phosphite coupling agents containing an alkyl or alkenyl group having at least 8 but not more than 24 carbons may be used alone or in combinations of two or more.

In the treatment with a coupling agent containing an alkyl or alkenyl group having at least 8 but not more than 24 carbons, the coupling agent and an aqueous medium required to hydrolyze the coupling agent may be mixed with the magnetic powder, followed by heat treatment in an inert gas atmosphere to form a coupling agent coating. Examples of the aqueous medium required to hydrolyze the coupling agent include acidic aqueous solutions such as acetic acid, sulfuric acid, and phosphoric acid aqueous solutions, and basic aqueous solutions such as ammonia water, sodium hydroxide and potassium hydroxide aqueous solutions. The amount of the coupling agent mixed is preferably at least 0.01 but not more than 1 part by weight, more preferably at least 0.05 but not more than 0.5 parts by weight, per 100 parts by weight of the magnetic powder. With an amount of less than 0.01 parts by weight, sufficient lubricity may not be provided to the magnetic powder, while with an amount of more than 1 part by weight, the mechanical strength of the molded article may be impaired.

The treatment with a coupling agent may be performed using a silane coupling agent different from the silane coupling agents containing an alkyl or alkenyl group having at least 8 but not more than 24 carbons (i.e., a silane coupling agent containing no alkyl or alkenyl group having at least 8 but not more than 24 carbons). Examples of such silane coupling agents different from the silane coupling agents containing an alkyl or alkenyl group having at least 8 but not more than 24 carbons include γ-(2-aminoethyl)aminopropyltrimethoxysilane, γ-(2-aminoethyl)aminopropylmethyldimethoxysilane, γ-methacryloxypropyltrimethoxysilane, γ-methacryloxypropyl-methyldimethoxysilane, N-β-(N-vinylbenzylaminoethyl)-γ-aminopropyltrimethoxysilane hydrochloride, γ-glycidoxypropyltrimethoxysilane, γ-mercaptopropyltrimethoxysilane, methyltrimethoxysilane, methyltriethoxysilane, vinyltriacetoxysilane, γ-chloropropyltrimethoxysilane, hexamethylenedisilazane, γ-anilinopropyltrimethoxysilane, vinyltrimethoxysilane, dimethyloctadecyl[3-(trimethoxysilyl)propyl]ammonium chloride, γ-chloropropylmethyldimethoxysilane, γ-mercaptopropylmethyldimethoxysilane, methyltrichlorosilane, dimethyldichlorosilane, trimethylchlorosilane, vinyltrichlorosilane, vinyltris(β-methoxyethoxy)silane, vinyltriethoxysilane, β-(3,4-epoxycyclohexyl)ethyltrimethoxysilane, γ-glycidoxypropylmethyldiethoxysilane, N-β-(aminoethyl)-γ-aminopropyltrimethoxysilane, N-β-(aminoethyl)-γ-aminopropylmethyldimethoxysilane, γ-aminopropyltriethoxysilane, ureidopropyltriethoxysilane, γ-isocyanatopropyltriethoxysilane, bis(3-triethoxysilylpropyl)tetrasulfane, γ-isocyanatopropyltrimethoxysilane, vinylmethyldimethoxysilane, 1,3,5-N-tris(3-trimethoxysilylpropyl)isocyanurate, and N-(1,3-dimethylbutylidene)-3-(triethoxysilyl)-1-propanamine.

Examples of such silane coupling agents having a cyclic structure include coupling agents having an alicyclic structure such as a monocyclic or bicyclic ring or an aromatic ring as the cyclic structure. Examples of coupling agents having a norbornene backbone (bicyclic ring) include 2-(bicyclo[2.2.1]hept-5-en-2-yl)-ethyltrimethoxysilane, 2-(bicyclo[2.2.1]hept-5-en-2-yl)ethyltriethoxysilane, 2-(bicyclo[2.2.1]hept-5-en-2-yl)trimethoxysilane, 2-(bicyclo[2.2.1]hept-5-en-2-yl)triethoxysilane, 2-(bicyclo[2.2.1]hept-2-enyl)ethynyltrimethoxysilane, 2-(bicyclo[2.2.1]hept-2-enyl)ethynyltriethoxysilane, 2-(bicyclo[2.2.1]hept-5-en-2-yl)hexyltrimethoxysilane, and 2-(bicyclo[2.2.1]hept-5-en-2-yl)hexyltriethoxysilane. Examples of coupling agents having an aromatic ring backbone include N-phenyl-3-aminopropyltrimethoxysilane, N-aminoethylaminomethylphenyl-3-ethyltrimethoxysilane, p-styryltrimethoxysilane, and m-allylphenylpropyltriethoxysilane. These silane coupling agents may be used alone or in combinations of two or more. In view of properties such as compatibility with the thermosetting resin, sliding properties with respect to the magnetic powder surface, and heat resistance, silane coupling agents having a cyclic structure are preferred among these, with silane coupling agents having a norbornene backbone being more preferred, with 2-(bicyclo[2.2.1]hept-5-en-2-yl)-ethyltrimethoxysilane or 2-(bicyclo[2.2.1]hept-5-en-2-yl)ethyltriethoxysilane being still more preferred.

In the treatment with a silane coupling agent containing no alkyl or alkenyl group having at least 8 but not more than 24 carbons, the silane coupling agent and an aqueous medium required to hydrolyze the silane coupling agent may be mixed with the magnetic powder, followed by heat treatment in an inert gas atmosphere to form a silane coupling agent coating. Examples of the aqueous medium required to hydrolyze the silane coupling agent include acidic aqueous solutions such as acetic acid, sulfuric acid, and phosphoric acid aqueous solutions, and basic aqueous solutions such as ammonia water, sodium hydroxide and potassium hydroxide aqueous solutions. The amount of the silane coupling agent mixed is preferably at least 0.1 but not more than 2 parts by weight, more preferably at least 0.2 but not more than 1.2 parts by weight, per 100 parts by weight of the magnetic powder. With an amount of less than 0.1 parts by weight, the coupling agent tends to produce only a small effect, while with an amount of more than 2 parts by weight, the magnetic powder tends to be aggregated, resulting in a decrease in magnetic properties.

In order to enhance lubricity of the magnetic powder to reduce friction between the particles during the compression molding and thereby produce a molded article highly filled with the magnetic powder, the treatment with a coupling agent is preferably carried out by treatment with a silane coupling agent containing no alkyl or alkenyl group having at least 8 but not more than 24 carbons and then with a coupling agent containing an alkyl or alkenyl group having at least 8 but not more than 24 carbons.

The magnitude of the external magnetic field applied for magnetic orientation is not limited, but is preferably 0.5 T or more, more preferably 1 T or more. An external magnetic field of less than 0.5 T tends to fail to sufficiently orient the magnet.

The structure of the mold used in the first compression step is not limited, and may be, for example, a mold including an external die, an inner plate placed in the external die, punches for applying pressure upward or downward, and a spring for holding the external die. The mold preferably has an inner plate to facilitate removal of the extra thermosetting resin in the second compression step. The size of the mold is not limited, but is preferably such that the molded article has a volume of at least 0.1 but not more than 10 $cm^3$ to facilitate removal of the extra thermosetting resin.

The magnitude of pressure applied to the mold is not limited, but is preferably at least 0.1 but less than 4 ton/$cm^2$, more preferably at least 0.5 but less than 2 ton/$cm^2$. At a pressure of less than 0.1 ton/$cm^2$, the magnetic powder tends to fail to undergo reorientation, resulting in a decrease in the magnetic powder filling factor of the second molded article. At a pressure of not less than 4 ton/$cm^2$, the first molded article tends to be insufficiently impregnated with the resin, causing molding defects.

Second Compression Step

The second compression step includes bringing the first molded article into contact with a thermosetting resin having a viscosity of 200 mPa·s or less, followed by compression to obtain a second molded article. The magnetic powder used in the present disclosure, which has a very small average particle size of 10 μm or less and is bulky, will be filled at a low filling factor. When the magnetic powder sufficiently magnetically oriented in the first compression step is contacted and compressed with the thermosetting resin, the extra thermosetting resin is removed to increase the magnetic powder filling factor and magnetic orientation ratio, thereby improving the magnetic properties of the bonded magnet.

The contact between the first molded article and the thermosetting resin may be carried out by any method, such as by adding the thermosetting resin to the first molded article in the mold to cause impregnation. The volume of the thermosetting resin to be contacted is not limited, but is preferably at least 0.25 but not more than 2 times, more preferably at least 0.5 but not more than 1.5 times the volume of the molded article. With a factor of less than 0.25 times, insufficient impregnation of the first molded article with the thermosetting resin tends to occur, causing molding defects. With a factor of more than 2 times, the resin and magnetic powder tend to overflow from the mold, resulting in a reduced yield as well as the need to remove the overflow material.

The viscosity of the thermosetting resin is 200 mPa·s or less, preferably 100 mPa·s or less, more preferably 50 mPa·s or less, still more preferably 15 mPa·s or less, most preferably 10 mPa·s or less. With a viscosity of more than 200 mPa·s, insufficient impregnation tends to occur, causing molding defects.

The thermosetting resin may be any resin capable of thermosetting, and examples include thermosetting monomers, thermosetting prepolymers, and thermosetting polymers. Examples of the thermosetting monomers include norbornene-based monomers, epoxy monomers, phenolic monomers, acrylic monomers, and vinyl ester monomers. Examples of the norbornene-based monomers include tricyclo[5.2.1.$0^{2,6}$]deca-3,8-diene (dicyclopentadiene), tricyclo[5.2.1.$0^{2,6}$]decan-3-ene, bicyclo[2.2.1]hepta-2,5-diene (2,5-norbornadiene), bicyclo[2.2.1]hept-2-ene (2-norbornene), bicyclo[3.2.1]oct-2-ene, 5-ethylidene-2-norbornene, bicyclo[2.2.1]hept-5-ene-2,3-dicarboxylic anhydride, 5-vinylbicyclo[2.2.1]hept-2-ene, and tetracyclo[6.2.1.$1^{3,6}$.$0^{2,7}$]dodeca-4-ene. Examples of the thermosetting prepolymers include epoxy resins, phenol resins, melamine resins, guanamine resins, unsaturated polyesters, vinyl ester resins, diallyl phthalate resins, silicone resins, alkyd resins, furan resins, acrylic resins, urea resins, and allyl carbonate resins. Examples of the thermosetting polymers include polyurethane resins, polyimide resins, and polyester resins.

The thermosetting resin may be added together with an initiator or curing agent for the thermosetting resin. Examples of the initiator include Grubbs catalysts, dihalogens, and azo compounds. Examples of the curing agent include amine curing agents, acid anhydride curing agents, polyamide curing agents, imidazole curing agents, phenol resin curing agents, polymercaptan resin curing agents, polysulfide resin curing agents, organic acid hydrazide curing agents, and isocyanate curing agents. Examples of the amine curing agents include diaminodiphenylsulfone, metaphenylenediamine, diaminodiphenylmethane, diethylenetriamine, and triethylenetetramine.

The magnitude of pressure applied in the second compression step is not limited, but is preferably not less than the compression pressure of the first compression step in order to produce a more highly filled magnet. Specifically, it is preferably at least 4 but not more than 11 ton/cm$^2$, more preferably at least 6 but not more than 10 ton/cm$^2$. At a pressure of less than 4 ton/cm$^2$, the magnetic powder filling factor tends to be insufficiently increased. At a pressure of more than 11 ton/cm$^2$, the coercive force tends to be reduced.

As with the first compression step, the second compression step may include magnetic orientation. The magnitude of the external magnetic field applied for magnetic orientation is not limited, and the magnitude of the external magnetic field in the first compression step may be used without any change.

Heat Treatment Step

The temperature of heat treatment is not limited, but is preferably at least 100° C. but not higher than 150° C., more preferably at least 110° C. but not higher than 130° C. At a temperature of lower than 100° C., curing of the resin tends to be insufficient, resulting in poor strength. At a temperature of higher than 150° C., oxidation of the resin by the air tends to proceed, resulting in poor strength.

The duration of heat treatment is not limited, but is preferably at least 1 but not more than 120 minutes, more preferably at least 3 but not more than 60 minutes. With a duration of less than 1 minute, curing of the resin tends to be insufficient, resulting in poor strength. With a duration of more than 120 minutes, oxidation of the resin by the air tends to proceed, resulting in poor strength.

After the heat treatment, the inner plate and punches may be drawn out of the mold to remove the molded article (bonded magnet), which may then be magnetized by applying a pulse magnetic field in the orientation direction.

The magnetizing field is preferably at least 1 but not higher than 36 T, more preferably at least 3 but not higher than 12 T. With a field of lower than 1 T, the magnet may be insufficiently magnetized and thus fail to exhibit remanence. With a field of higher than 36 T, the heat generated during the magnetization may cause excessive heat shock, resulting in breakage of the magnet.

The bonded magnet according to the present embodiment contains a magnetic powder having an average particle size of 10 μm or less, and a cured product of a thermosetting resin having a viscosity of 200 mPa·s or less, and further has a percentage of lack of impregnation of 1% or less. This bonded magnet may be obtained by, for example, the method of preparing a bonded magnet of the present disclosure. The magnetic powder, thermosetting resin, average particle size, and other properties of the bonded magnet are as described above.

In the method of preparing a bonded magnet and the bonded magnet of the present disclosure, the percentage of lack of impregnation of the bonded magnet refers to the ratio of the area not actually occupied by the resin to the area that should be occupied by the resin. The percentage of lack of impregnation is preferably 12% or less, more preferably 10% or less, still more preferably 5% or less, most preferably 1% or less. A percentage of lack of impregnation of more than 12% tends to result in a decrease in mechanical strength. The percentage of lack of impregnation is determined by performing binary analysis (BMPEdit) of the brightness of an image observed with a light microscope at the lowest magnification so that the entire cross section of the bonded magnet is contained, to determine the area of the portion not impregnated with the resin (the area of the resin-lacking portion), and the area of the entire cross section, i.e., the outline of the image (the area of the cross section), and calculating the ratio of the area of the resin-lacking portion to the area of the cross section. The cross section of the bonded magnet is created by cutting the prepared bonded magnet so that the cross section passes through the center of the surface contacted with the resin and is perpendicular to the contact surface, and further has the largest area.

The proportion of the magnetic powder in the bonded magnet, i.e., filling factor, is not limited, but is preferably 71% by volume or more, more preferably 72% by volume or more. A filling factor of less than 71% by volume tends to lead to insufficient remanence.

The coercive force of the bonded magnet is not limited, but is preferably 1020 kA/m or more, more preferably 1150 kA/m or more. A coercive force of less than 1020 kA/m tends to lead to demagnetization during use in applications such as high-power motors.

The remanence of the bonded magnet is not limited, but is preferably 0.75 T or more, more preferably 0.8 T or more. A remanence of less than 0.75 T tends to lead to insufficient torque during use in applications such as motors.

The magnetic flux orientation ratio of the bonded magnet is preferably 80% or higher, more preferably 81% or higher. A magnetic orientation ratio of 80% or higher will lead to high remanence. The magnetic orientation ratio is determined by dividing the remanence of the bonded magnet by the product of the remanence of the magnetic powder and the volume filling factor of the bonded magnet.

EXAMPLES

Examples are described below. It should be noted that "%" is by weight unless otherwise specified.

Production Example 1

Alkyl Silicate Treatment Step

To a mixer were added 300 g of a SmFeN magnetic powder (average particle size: 3 μm) and 7.5 g of ethyl silicate ($Si_5O_4(OEt)_{12}$), and they were mixed for five minutes in a nitrogen atmosphere. To the mixture was added 0.8 g of ammonia water (pH 11.7), and they were mixed for five minutes, followed by heat treatment at 180° C. under reduced pressure for 10 hours to obtain a SmFeN anisotropic magnetic powder having a silica thin film formed on the surface.

Surface Treatment Step 1

To a mixer were added 300 g of the silica-treated magnetic powder and 1.5 g of an acetic acid aqueous solution (pH 4), and they were mixed for five minutes in a nitrogen atmosphere. To the mixture was added 3 g of 2-(bicyclo[2.2.1]hept-5-en-2-yl)ethyltrimethoxysilane (Silane coupling agent X-88-351 available from Shin-Etsu Chemical Co., Ltd.) as a silane coupling agent A, and they were mixed for five minutes in a nitrogen atmosphere. The mixture was taken out and then subjected to heat treatment at 100° C. under reduced pressure for 5 hours to obtain a magnetic powder having a coating layer formed of the coupling agent A on the silica film.

Surface Treatment Step 2

To a mixer were added 300 g of the SmFeN magnetic powder with the coating layer formed of the coupling agent A and 1.5 g of an acetic acid aqueous solution (pH 4), and they were mixed for five minutes in a nitrogen atmosphere. To the mixture was added a mixed solution containing 0.5 g of octadecyltriethoxysilane (Tokyo Chemical Industry Co., Ltd.) as a coupling agent B and 0.5 g of ethanol, and they were mixed for five minutes in a nitrogen atmosphere. The resulting mixture was subjected to heat treatment at 100° C. under reduced pressure for 5 hours to obtain a SmFeN anisotropic magnetic powder having a coating layer formed of the coupling agents A and B on the surface (magnetic powder 1).

Production Example 2

A SmFeN anisotropic magnetic powder having a coating layer formed of coupling agents A and B on the surface (magnetic powder 2) was prepared as in Production Example 1, except that octyltriethoxysilane was used in place of the octadecyltriethoxysilane as a coupling agent B in the surface treatment step 2 of Production Example 1.

Production Example 3

A SmFeN anisotropic magnetic powder having a coating layer formed of coupling agents A and B on the surface (magnetic powder 3) was prepared as in Production Example 1, except that oleyl acid phosphate was used in place of the octadecyltriethoxysilane as a coupling agent B in the surface treatment step 2 of Production Example 1.

Production Example 4

A SmFeN anisotropic magnetic powder having a coating layer formed of coupling agents A and B on the surface (magnetic powder 4) was prepared as in Production Example 1, except that dioleyl hydrogen phosphite was used in place of the octadecyltriethoxysilane as a coupling agent B in the surface treatment step 2 of Production Example 1.

Example 1

First Compression Step

An amount of 0.8 g of the SmFeN anisotropic magnetic powder with a coating layer formed of coupling agents A and B on the surface prepared in Production Example 1 was loaded into a non-magnetic carbide mold including a 5 mm square cavity. The upper and lower punches were set and the magnetic powder was compressed at a compression pressure of 1 ton/cm$^2$ in an orientation field of 1 T to obtain a first molded article.

Second Compression Step

Next, the upper punch was removed and 0.1 g of a mixture of dicyclopentadiene monomer (viscosity: 3 mPa·s, density: 1.02 g/cc) and a reaction initiator (dichloro[1,3-bis(2,6-isopropylphenyl)-2-imidazolidinylidene](2-isopropylphenylmethylene)ruthenium (III)) was added dropwise to the first molded article and retained for 30 seconds. The upper punch was set again and the resulting molded article was compressed at a compression pressure of 8 ton/cm$^2$ in an orientation field of 1 T to cause impregnation with dicyclopentadiene monomer while discharging the extra mixture component, thereby obtaining a second molded article.

Heat Treatment Step

While still being compressed, the second molded article was then heated at 120° C. for 15 minutes to obtain a bonded magnet. The density, volume filling factor, coercive force, remanence, percentage of lack of impregnation, and magnetic orientation ratio of the bonded magnet were measured as described below. Table 1 shows the results.

Density and Volume Filling Factor

The density of the bonded magnet was determined from the size and weight measurements. The density was applied to the calibration curve between magnetic powder filling factor and magnet density prepared based on the densities of the magnetic powder and the resin to calculate the volume filling factor.

Percentage of Lack of Impregnation

The prepared bonded magnet was cut so that the cross section passed through the center of the surface contacted with dicyclopentadiene monomer and was perpendicular to the contact surface, and further had the largest area. The cross section was sanded with sandpaper. FIG. 1 shows an image of the cross section of the bonded magnet of Example 1 observed with a light microscope (magnification 25×). As can be seen from the image, the resin was present uniformly over the entire cross section and a lacking portion where impregnation failed was not observed.

Remanence, Coercive Force, and Magnetic Orientation Ratio

The SmFeN magnetic powder was packed into a sample vessel together with a paraffin wax. After the paraffin wax was melted with a dryer, the easy axes of magnetization were aligned in an orientation field of 2 T. The magnetically oriented sample was pulse magnetized in a magnetizing field of 6 T, and the remanence (T) and coercive force (iHc, kA/m) of the sample were measured using a vibrating sample magnetometer (VSM) with a maximum field of 2 T. The SmFeN magnetic powder was found to have a remanence of 1.317 T and a coercive force of 1300 kA/m. Moreover, the prepared bonded magnet was measured for remanence (T) and coercive force (iHc, kA/m) using a BH tracer and found to have a remanence of 0.85 T and a coercive force of 1190 kA/m. Thus, the magnetic orientation ratio was 0.85 (T)/(0.751×1.317 (T))×100=85.9%.

Examples 2 to 5

Figure 2:
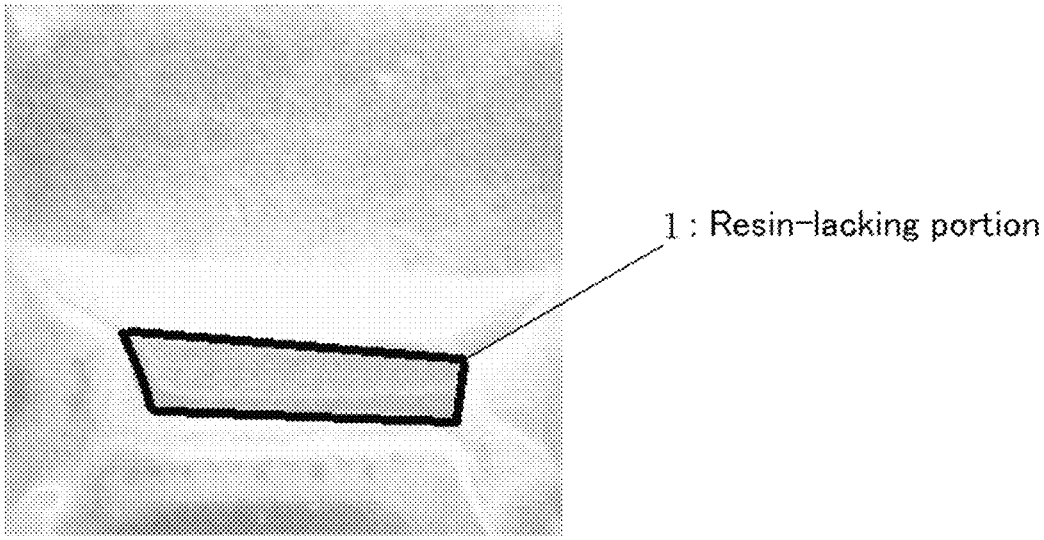
FIG. 2 shows a cross section of a bonded magnet of Example 4.

Bonded magnets were prepared as in Example 1, except that the compression pressure in the first compression step was changed as indicated in Table 1. FIG. 2 shows an image of the cross section of the bonded magnet of Example 4 observed in the same manner as in Example 1 (magnification 25×) with respect to the percentage of lack of impregnation of Example 4. Since a resin-lacking portion was present in the center of the cross section as demonstrated in FIG. 2, the area of the resin-lacking portion and the area of the cross section were calculated by binary analysis (BMPEdit), and the percentage of lack of impregnation was found to be 11.1%.

Examples 6 to 8

Bonded magnets were prepared as in Example 1, except that the magnetic powder was changed as indicated in Table 1.

Comparative Example 1

A bonded magnet was prepared as in Example 1, except that compression was performed without magnetic orientation in the first compression step.

Comparative Example 2

An amount of 0.8 g of the SmFeN magnetic powder prepared in Production Example 1 and a mixture of 0.05 g of dicyclopentadiene monomer (viscosity/25° C.: 3 mPa·s, density: 1.02 g/cc) as a binder component and 0.002 g of dichloro[1,3-bis(2,6-isopropylphenyl)-2-imidazolidinylidene]-(2-isopropylphenylmethylene)ruthenium (III) as a reaction initiator were mixed in a mortar. The resulting mixture was loaded into a non-magnetic carbide mold including a 5 mm square cavity, and then compressed upward and downward of the mold at a compression pressure of 8 ton/cm$^2$ in an orientation field of 1 T while discharging the extra binder component. The product, while being maintained in that state, was heated at 120° C. for 15 minutes to obtain a bonded magnet. Table 1 shows the results of density, volume filling factor, coercive force, remanence, percentage of lack of impregnation, and magnetic orientation ratio of the bonded magnet.

TABLE 1

| | Example No. | | | | | | | | | |
|---|---|---|---|---|---|---|---|---|---|---|
| | Example 1 | Example 2 | Example 3 | Example 4 | Example 5 | Example 6 | Example 7 | Example 8 | Comparative Example 1 | Comparative Example 2 |
| Magnetic powder | Magnetic powder 1 | | | | | Magnetic powder 2 | Magnetic powder 3 | Magnetic powder 4 | Magnetic powder 1 | |
| Monomer | Dicyclopentadiene | | | | | | | | | |
| Resin (Impregnated/Mixed) | Impregnated | Impregnated | Impregnated | Impregnated | Impregnated | Impregnated | Impregnated | Impregnated | Impregnated | Mixed |
| First compression molding pressure (ton/cm$^2$) | 1 | 0.5 | 2 | 4 | 8 | 1 | 1 | 1 | 1 | Absent |
| Orientation field | Present | Present | Present | Present | Present | Present | Present | Present | Absent | |
| Second compression molding pressure (ton/cm$^2$) | 8 | | | | | | | | | |
| Orientation field | Present | | | | | | | | | |
| Density (g/cc) | 5.92 | 5.66 | 5.80 | 5.86 | 5.88 | 5.72 | 5.81 | 5.8 | 5.92 | 5.59 |
| Filling factor (vol. %) | 75.1 | 72.1 | 73.3 | 74.2 | 74.6 | 72 | 73.6 | 73.1 | 75.1 | 70.1 |
| Percentage of lack of impregnation (area %) | 0 | 0 | 0 | 11.1 | 11.5 | 0 | 0 | 0 | 0 | — |
| Coercive force (iHc, kA/m) | 1190 | 1200 | 1170 | 1130 | 1030 | 1150 | 1180 | 1200 | 1190 | 1240 |
| Remanence (T) | 0.85 | 0.8 | 0.81 | 0.82 | 0.83 | 0.75 | 0.85 | 0.87 | 0.57 | 0.73 |
| Magnetic orientation ratio (%) | 85.9 | 84.2 | 83.9 | 83.8 | 84.4 | 80.3 | 85.1 | 87 | 57.6 | 79 |

Table 1 demonstrates that the Examples, which included first and second compression steps, exhibited increased filling factors and improved magnetic properties as compared to Comparative Example 2. It is also demonstrated that the Examples, which included compressing a magnetic powder while magnetically orienting it in the first compression step, exhibited increased magnetic orientation ratios and improved magnetic properties as compared to Comparative Example 1.

Example 9

The same procedure as described in Example 1 was followed, except that 0.1 g of a mixture of a low-viscosity epoxy resin (Bond E205 available from Konishi Co., Ltd., viscosity/25° C.: 100 mPa·s, density: 1.10 g/cc) and a curing agent (E205 available from Konishi Co., Ltd.) was added dropwise in place of the mixture of dicyclopentadiene monomer and a reaction initiator in the second compression step. Table 2 shows the results of density, volume filling factor, coercive force, remanence, percentage of lack of impregnation, and magnetic orientation ratio of the prepared bonded magnet.

Comparative Example 3

The same procedure as described in Example 1 was followed, except that 0.1 g of a mixture of a low-viscosity epoxy resin (Bond E206SS available from Konishi Co., Ltd., viscosity/25° C.: 450 mPa·s, density: 1.15 g/cc) and a curing agent (E206SS available from Konishi Co., Ltd.) was added dropwise in place of the mixture of dicyclopentadiene monomer and a reaction initiator in the second compression step. However, the product was not moldable.

Comparative Example 4

The same procedure as described in Example 1 was followed, except that 0.1 g of a mixture of a liquid epoxy resin (YDF-170 available from Nippon Steel & Sumitomo Metal Corporation, viscosity: 2000 mPa·s, density: 1.19 g/cc) and a curing agent (E205 available from Konishi Co., Ltd.) was added dropwise in place of the mixture of dicyclopentadiene monomer and a reaction initiator in the second compression step. However, the product was not moldable.

Comparative Example 5

An amount of 0.8 g of the SmFeN magnetic powder prepared in Production Example 1 and 0.1 g of a mixture of a low-viscosity epoxy resin (Bond E205 available from Konishi Co., Ltd., viscosity/25° C.: 100 mPa·s, density: 1.10 glee) as a binder component and a curing agent (E205 available from Konishi Co., Ltd.) were mixed in a mortar. The resulting mixture was loaded into a non-magnetic carbide mold including a 5 mm square cavity, and then compressed upward and downward of the mold at a compression pressure of 8 ton/cm$^2$ in an orientation field of 1 T while discharging the extra binder component. The product, while being maintained in that state, was heated at 120° C. for 15 minutes to mold a bonded magnet by heat curing. Table 2 shows the results of density, volume filling factor, coercive force, remanence, percentage of lack of impregnation, and magnetic orientation ratio of the bonded magnet.

TABLE 2

| Example No. | Example 9 | Comparative Example 3 | Comparative Example 4 | Comparative Example 5 |
|---|---|---|---|---|
| Magnetic powder | Magnetic powder 1 | | | |
| Resin | Epoxy resin | | | |
| Viscosity (mPa · s) | 100 | 450 | 2000 | 100 |
| Resin (Impregnated/Mixed) | Impregnated | Impregnated | Impregnated | Mixed |
| First compression molding pressure (ton/cm$^2$) | 1 | 1 | 1 | Absent |
| Orientation field | Present | Present | Present | |
| Second compression molding pressure (ton/cm$^2$) | 8 | | | |
| Orientation field | Present | | | |
| Density (g/cc) | 5.55 | Not moldable | Not moldable | 5.35 |
| Filling factor (vol. %) | 69.0 | Not moldable | Not moldable | 65.9 |
| Percentage of lack of impregnation (area %) | 0 | — | — | — |
| Coercive force (iHc, kA/m) | 1000 | — | — | 1000 |
| Remanence (T) | 0.74 | Not moldable | Not moldable | 0.7 |
| Magnetic orientation ratio (%) | 81.3 | — | — | 80.6 |

Table 2 demonstrates that a viscosity of more than 200 mPa·s resulted in failure in molding. It is also demonstrated that the Example, which included bringing a first molded article into contact with a thermosetting resin having a viscosity of 200 mPa·s or less, exhibited increased filling factor and magnetic orientation ratio and improved magnetic properties as compared to Comparative Example 5.

The method of preparing a bonded magnet of the present disclosure can produce a bonded magnet having a high magnetic powder content and good magnetic properties, and is thus suitable for use in applications such as motors.

What is claimed is:

1. A method of preparing a bonded magnet, the method comprising:

a first compression step of compressing a magnetic powder having an average particle size of 10 μm or less while magnetically orienting it in a mold to obtain a first molded article;

a second compression step of bringing the first molded article that is magnetically oriented into contact with a thermosetting resin having a viscosity of 200 mPa·s or less in the mold, followed by compression in the mold to obtain a second molded article; and a heat treatment step of heat treating the second molded article, wherein a magnitude of pressure applied in the second compression step is at least 4 ton/cm$^2$, wherein the mold has an inner plate to facilitate removal of extra thermosetting resin in the second compression step, and wherein the size of the mold is such that the first molded article has a volume of at least 0.1 but not more than 10 cm$^3$.

2. The method according to claim 1, wherein the thermosetting resin is a thermosetting monomer or a thermosetting prepolymer.

3. The method according to claim 1, wherein a compression pressure of the second compression step is not less than a compression pressure of the first compression step.

4. The method according to claim 1, wherein a compression pressure of the first compression step is less than 4 ton/cm$^2$.

5. The method according to claim 1, wherein the bonded magnet has a percentage of lack of impregnation of 1% or less.

6. The method according to claim 2, wherein the thermosetting monomer is a norbornene-based monomer.

7. The method according to claim 6, wherein the norbornene-based monomer is dicyclopentadiene.

8. The method according to claim 1, wherein the magnetic powder is present in a proportion of 71% by volume or more relative to the bonded magnet.

9. The method according to claim 1, wherein the magnetic powder is a SmFeN magnetic powder.

10. The method according to claim 1, wherein the magnetic powder is treated with a coupling agent containing an alkyl or alkenyl group having at least 8 but not more than 24 carbons.

11. The method according to claim 10, wherein the coupling agent is at least one selected from the group consisting of a silane coupling agent, a phosphate coupling agent, and a hydrogen phosphite coupling agent.

* * * * *